US007993157B2

(12) United States Patent
Azizi-Namini

(10) Patent No.: US 7,993,157 B2
(45) Date of Patent: Aug. 9, 2011

(54) CABLE CONNECTOR ASSEMBLY

(75) Inventor: Keyvan Azizi-Namini, Washington, DC (US)

(73) Assignee: TDL Group USA, LLC, Bloomfield Hills, MI (US)

( * ) Notice: Subject to any disclaimer, the term of this patent is extended or adjusted under 35 U.S.C. 154(b) by 0 days.

(21) Appl. No.: 12/119,801

(22) Filed: May 13, 2008

(65) Prior Publication Data

US 2009/0286408 A1 Nov. 19, 2009

(51) Int. Cl.
*H01R 12/24* (2006.01)

(52) U.S. Cl. ... 439/493; 439/76.1; 439/469; 439/607.46

(58) Field of Classification Search ..... 439/465–469, 439/455, 493, 76.1, 610, 460, 607.46, 607.41, 439/470–471, 472

See application file for complete search history.

(56) References Cited

U.S. PATENT DOCUMENTS

| | | | | |
|---|---|---|---|---|
| 4,592,612 | A * | 6/1986 | Kikuta | 439/610 |
| 4,653,825 | A * | 3/1987 | Olsson | 439/295 |
| 5,383,796 | A * | 1/1995 | Bowen et al. | 439/469 |
| 7,163,408 | B1 * | 1/2007 | Chen et al. | 439/76.1 |
| 7,297,028 | B2 * | 11/2007 | Daikuhara et al. | 439/610 |

* cited by examiner

*Primary Examiner* — Xuong M Chung-Trans
(74) *Attorney, Agent, or Firm* — Shariff & Yatooma PLC

(57) ABSTRACT

A housing having a first portion and a second portion for holding a cable device presenting a plurality of cables extending to a communication plate extending to an output outlet to cooperate with external devices. A locking device defined in the second portion to receive the plurality of cables and prevent movement of the plurality of cables relative within the housing. The housing is formed from metals, metal alloys, and combination thereof.

6 Claims, 3 Drawing Sheets

CABLE CONNECTOR ASSEMBLY

FIELD OF THE INVENTION

The subject invention relates to cables and more particularly to a housing to hold the cables disposed therein.

BACKGROUND OF THE INVENTION

Numerous housings for holding cables are available in cable industry today. However, there are lots of problems associated with the prior art housings. For example, if at least one of the elements of a cable device, such as a communication plate connected to an output outlet to cooperate with external devices, or a plurality of chips connected to the communication plate, will have to be replaced, the entire housing is replaced thereby preventing replacement of parts of the cable device.

Other issues associated with prior art design involves UBIC-H type a connector shell or housing that is unsteady or wobbly. Because the connector shell is heavy, a supporting pin next to the outside the UBIC-H shell fails to stabilize the connector at the point of connection. Since the prior art connector shells or housings are too heavy, the pins of get damaged at the connection point on the "Back-plain of the ONS switch", thereby negatively impacting on the entire connectivity.

The purpose of having DS3 cable connection is to have a very high bandwidth. The inside of the UBIC-H connector shell or housing designed by others truly affects the bandwidth. The coaxial strands inside the UBIC-H connector shall or housing has lot of stress on the cables because the inside wall fails to provide enough support to the cable.

Another problem associated with prior art housing is failure of the design to prevent or at least reduce the percentage of wear and tear of cables as the same frictionally engage the inner walls of the housing. Still another problem associated with the prior art cables is failure of the prior art designs to keep the cables in fixed positions within the housing thereby preventing relative movement of the cables within the housing.

Therefore, there remains an opportunity to improve upon prior art design of the housing to eliminate one or more problems associated with prior art design as set forth above.

SUMMARY OF THE INVENTION

A cable assembly of the present invention is used for holding a cable device having a plurality of cables extending to a communication plate connected to an output outlet to cooperate with external devices (not shown). A plurality of chips are connected to the communication plate. At least one central processing unit is connected to the communication plate to the output outlet to cooperate with the external devices. A housing having a top portion and a bottom portion presenting a peripheral wall of a uniformed thickness to define a dish for holding the cable device. The bottom portion and the top portion are formed from at least one of metal and metal alloys, and combination therewith.

A locking device is integral with the bottom portion and presents spaced walls extending generally parallel to the peripheral wall. A cable engaging surface extending between the spaced walls thereby forming a seat to receive the plurality of cables and preventing movement of the plurality of cables relative the spaced walls and the cable engaging surface. A first plate is removable connected to the spaced walls to prevent relative movement of the cables relative the spaced walls and to prevent the cables from moving beyond the spaced walls.

A pair of spaced members are integral with and extend outwardly from the bottom portion to receive the plurality of cables extending thereto. A second plate is removably connected to the spaced members to prevent relative movement of the cables relative the spaced members and to prevent the cables from moving beyond the spaced members thereby keeping the cables aligned between the spaced members and the spaced walls.

An advantage of the present invention is to provide a light weight and easy to manufacture housing device for holding a cable device having at least a communication plate connected to an output outlet to cooperate with external devices (not shown), and a plurality of chips are connected to the communication plate;

Another advantage of the present invention is to provide an alternative to prior art housings wherein this alternative solution is easily disassembled to allow replacement of parts of the cable device without recycling the entire housing with the cable device thereby providing a cost effective device; and Still another advantage of the present invention is to provide an inventive housing for preventing relative movement of the cables relative the housing thereby preventing wear-and-tear of the cables as the cable frictionally engage with the housing to keep the cables from being replaced.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
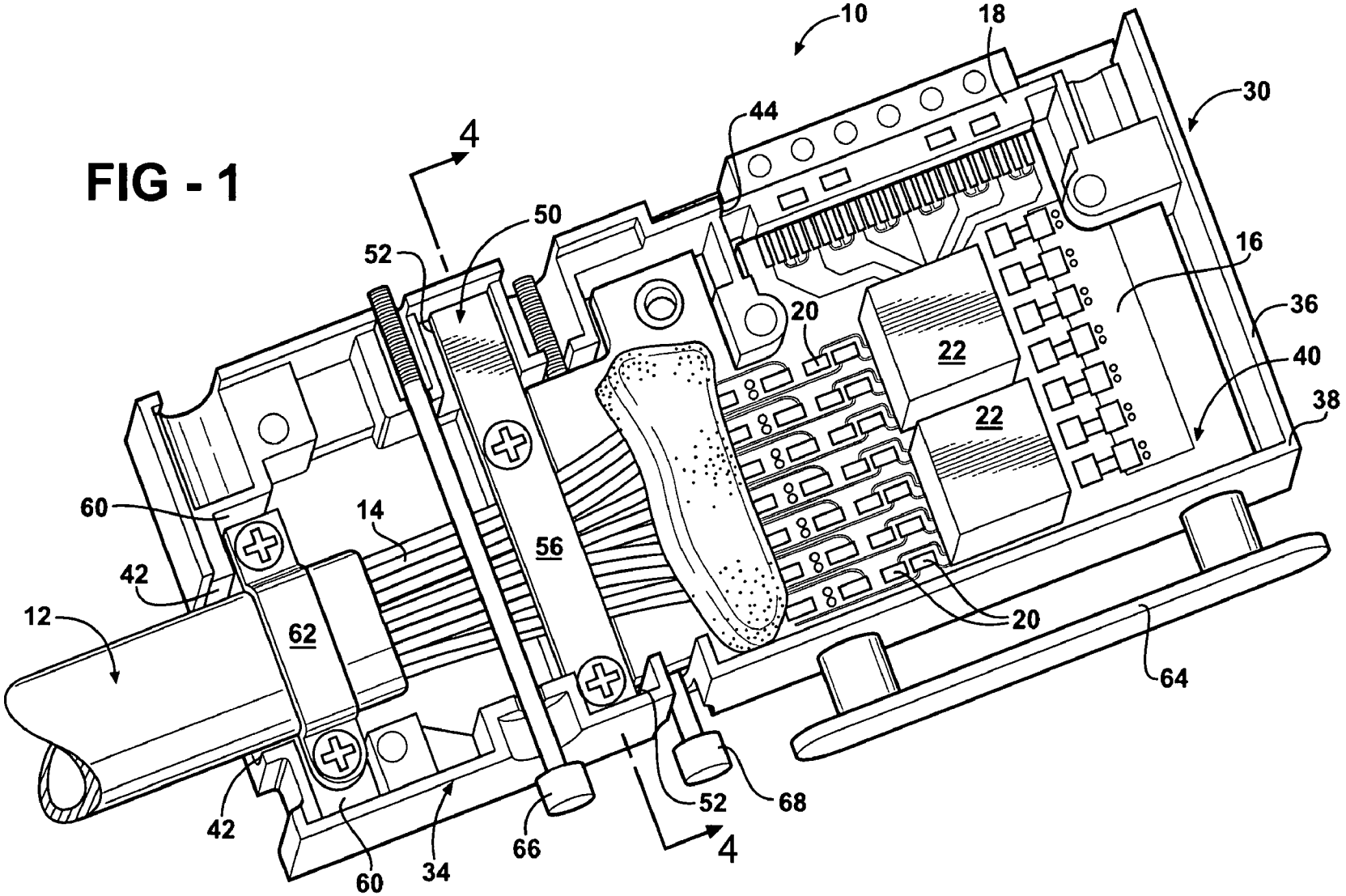
FIG. 1 is a perspective view of a bottom portion of a housing with a cable device disposed therein.
Figure 2:
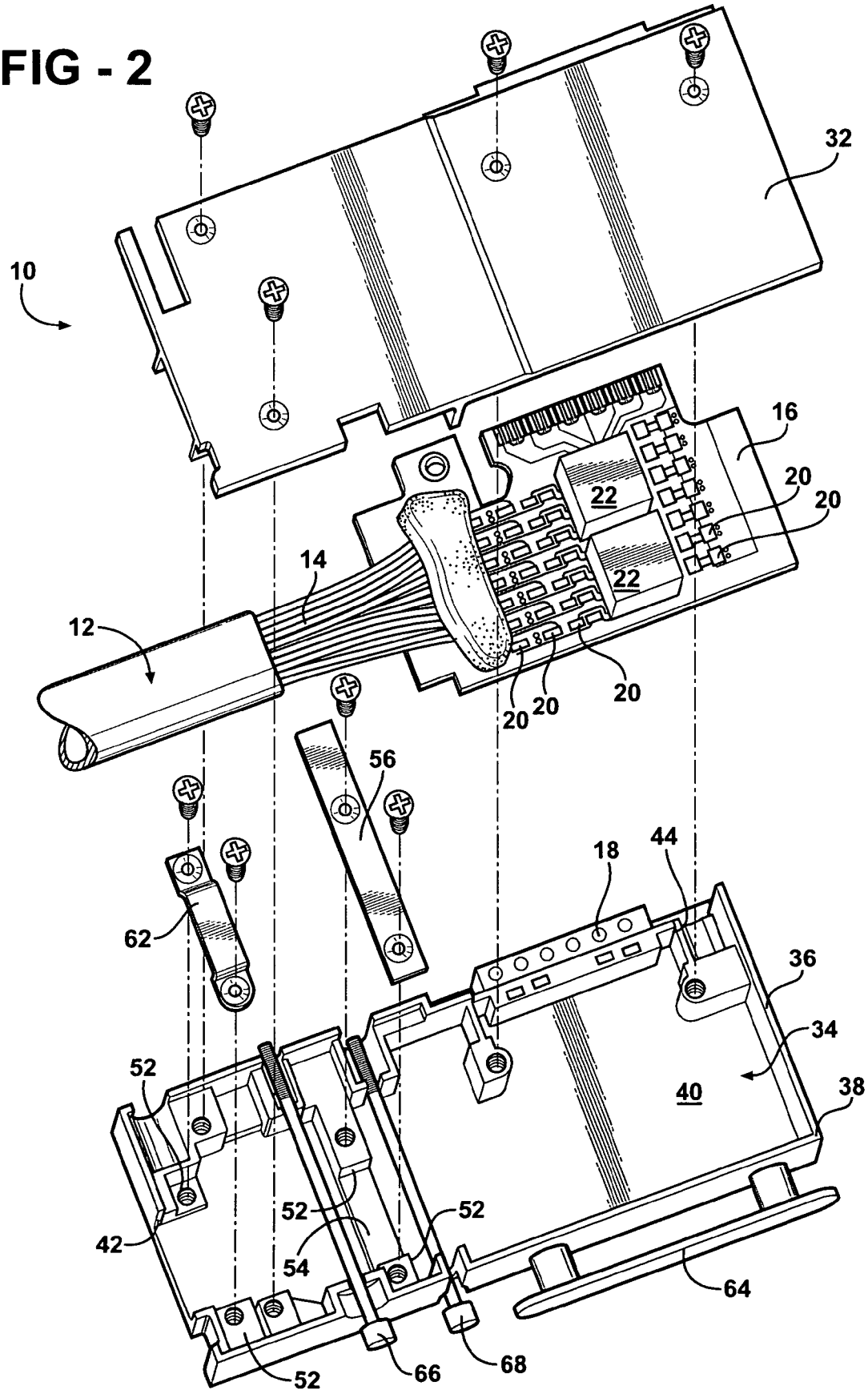
FIG. 2 is an exploded view of a cable assembly having the bottom portion of the housing as shown in FIG. 1, a top portion or cover of the housing, and the cable device of the present invention.
Figure 3:
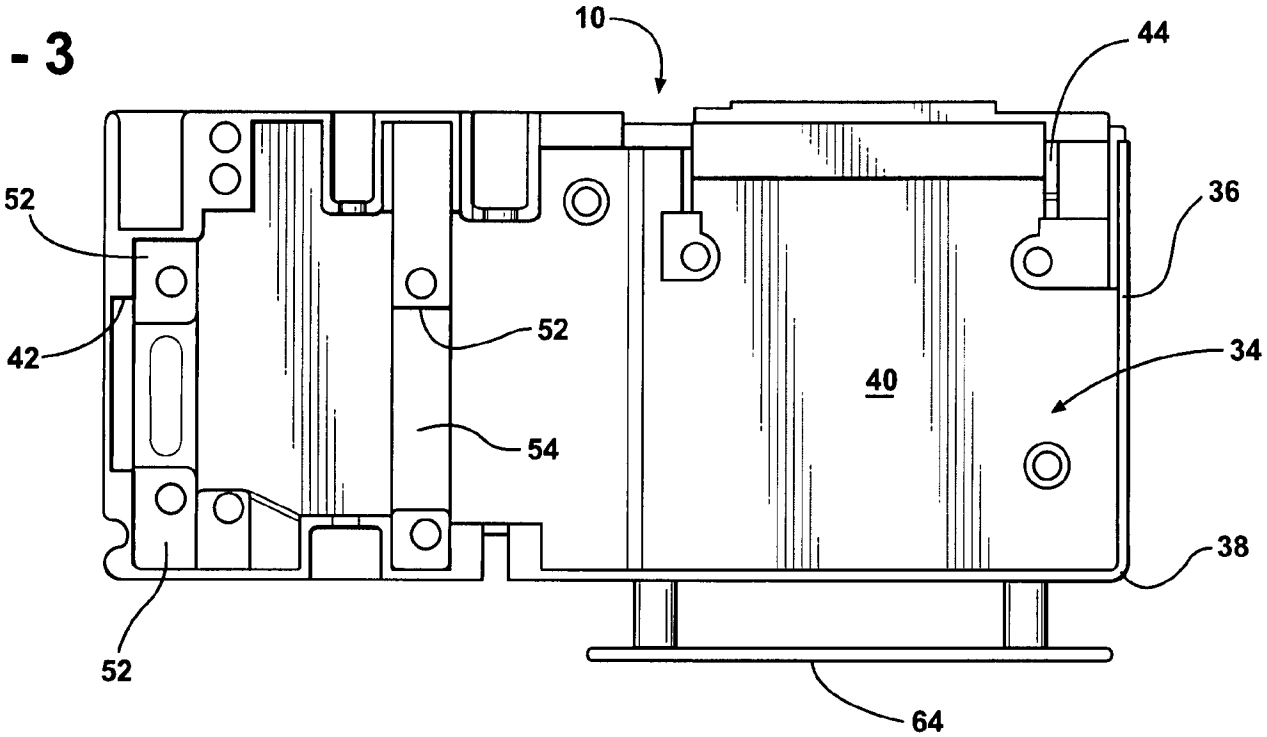
FIG. 3 is a top view of the bottom portion of the housing.
Figure 4:
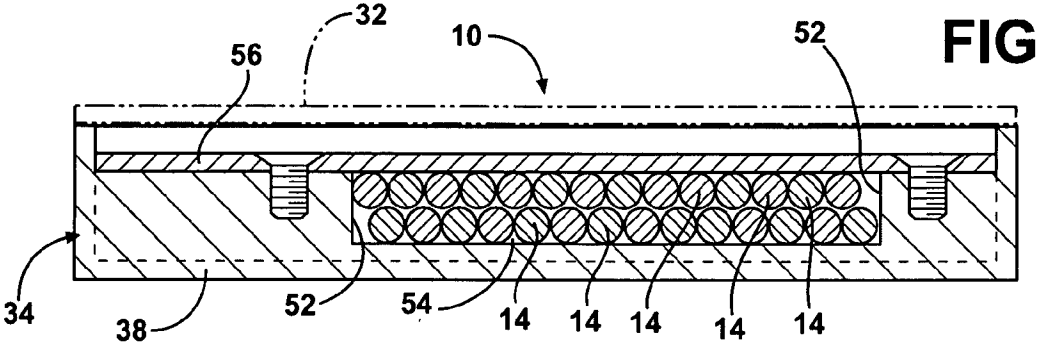
FIG. 4 illustrates a cross sectional view of the bottom portion of the housing taken along 4-4 illustrating a locking feature defined in the bottom portion for holding the cable device in a locking engagement.

Referring to the Figures, wherein like numerals indicate like or corresponding parts, a cable assembly is generally shown at 10. The cable assembly 10 includes a cable device, generally indicated at 12, having a plurality of cables 14 extending to a communication plate 16 cooperable with an output outlet 18 to communicate with external devices (not shown). A plurality of chips 20 are connected to the communication plate 16. At least one central processing unit 22 is disposed on the communication plate 16 extending to the output outlet 18 to cooperate with the external devices. Numerous other types of cables may be used without limiting the scope of the present invention. The configuration, type and number of the chips 20, the central processing units 22 are not intended to limit the scope of the present invention.

A housing, generally shown at 30, is used for securing the cable device 12. The housing 30 includes a top portion, generally indicated at 32, and a bottom portion, generally indicated at 34. The bottom portion 34 presents a peripheral wall 36 of a uniformed thickness 38 to define a dish, generally indicated at 40. The peripheral wall 36 defines a front opening 42 and a gate 44 to receive the output outlet 18 of the cable device 12. The bottom portion 34 and the top portion 32 are formed from at least one of metal and metal alloys, and combination therewith. The housing 30 may be formed from other materials without limiting the scope of the present invention.

Numerous housings for holding cables are available in cable industry today. For example, if at least one of the elements of a cable device, such as a communication plate connected to an output outlet to cooperate with external devices, or a plurality of chips connected to the communication plate, will have to be replaced, the entire housing is replaced thereby preventing replacement of parts of the cable device.

Another problem associated with prior art housing is failure of the design to prevent or at least reduce the percentage of wear and tear of cables as the same frictionally engage the inner walls of the housing. Still another problem associated with the prior art cables is failure of the prior art designs to keep the cables in fixed positions within the housing thereby preventing relative movement of the cables within the housing.

A locking device, generally indicated at 50, is provided to eliminate one or more problems associated with prior art designs. The locking device 50 is integral with the bottom portion 34 and present spaced walls 52 extending generally parallel to the peripheral wall 36. A cable engaging surface 54 extends between the spaced walls 52 thereby forming a seat to receive the plurality of cables 14 and preventing movement of the cables 14 relative the spaced walls 52 and the cable engaging surface 54. A first plate 56 is removably connected to the spaced walls 52 for preventing relative movement of the cables 14 relative the spaced walls 52 and preventing the cables 14 from moving beyond the spaced walls 52. The spaced walls 52 presenting a thickness different from the uniformed thickness 38 of the peripheral wall 36 of the bottom portion 34.

A second locking includes a pair of spaced members 60 integral with and extending outwardly from the bottom portion 34 at the front opening for receiving the plurality of cables 14 extending thereto. A second plate 62 is removable connected to the spaced members 60 to prevent relative movement of the cables 14 relative the spaced members 60 and preventing the cables 14 from moving beyond the spaced members 60 thereby keeping the cables 14 aligned between the spaced members 60 and the spaced walls 52. Alluding to the above, a handle 64 is connected to the peripheral wall 36. A pair of rods 66 and 68 extend through the peripheral wall 36 with one rod 66 extending above the cables 14 and the other rod 68 extends below the cables 14.

While the invention has been described as an example embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A cable assembly comprising:

a housing having a top portion and a bottom portion removable connected to one another with said bottom portion presenting a peripheral wall of a uniformed thickness to define a dish;

a cable device presenting a plurality of cables extending to a communication plate extending to an output outlet to cooperate with external devices and a plurality of chips connected to said communication plate and at least central processing unit extending to said output outlet to cooperate with the external devices;

a pair of rods extending through the peripheral wall; wherein the pair of rods defines a first rod extending below said cables and a second rod extending above said cables; and a locking device being integral with said bottom portion and presenting spaced walls extending generally parallel to said peripheral wall and a cable engaging surface extending between said spaced walls thereby forming a seat to receive said plurality of cables and preventing movement of said plurality of cables relative said spaced walls and said cable engaging surface;

wherein said locking device is further defined by a pair of spaced members integral with and extending outwardly from said bottom portion at a front opening for receiving said plurality of cables extending thereto, a second plate removable connected to said spaced members for preventing relative movement of said cables relative said spaced members and preventing said cables from moving beyond said spaced members thereby keeping said cables aligned between said spaced members and said spaced walls.

2. A cable assembly as set forth in claim 1 wherein said locking device is further defined by a first plate removable connected to said spaced walls for preventing relative movement of said cables relative said spaced walls and preventing said cables from moving beyond said spaced walls.

3. A cable assembly as set forth in claim 1 wherein said spaced walls present a thickness different from said uniformed thickness of said peripheral wall of said bottom portion.

4. A cable assembly as set forth in claim 1 wherein said peripheral wall defines a front opening exposed to said locking device and a gale to receive said output outlet of said cable device.

5. A cable assembly as set forth in claim 1 wherein said bottom portion and said top portion if formed from at least one of metal and metal alloys, and combination therewith.

6. A cable assembly comprising:

a cable device presenting a plurality of cables extending to a communication plate extending to an output outlet to cooperate with external devices, a plurality of chips connected to communication plate, and at least central processing unit extending to said output outlet to cooperate with the external devices;

a housing having a top portion and a bottom portion, said bottom portion presenting a peripheral wall of a uniformed thickness to define a dish; said peripheral wall defines a front opening and a gate to receive said output outlet of raid cable device, said bottom portion and said top portion formed from at least one of metal and metal alloys, and combination therewith;

a handle connected to said peripheral wall opposite from said output outlet of said cable device;

a pair of rods extending through the peripheral wall; wherein the pair of rods defines a first rod extending below said cables and a second rod extending above said cables;

a locking device being integral with said bottom portion and presenting spaced walls extending generally parallel to said peripheral wall and a cable engaging surface extending between said spaced walls thereby forming a seat to receive said plurality of cables and preventing movement of said plurality of cables relative said spaced walls and said cable engaging surface;

a first plate removable connected to said spaced walls for preventing relative movement of said cables relative said spaced walls and preventing said cables from moving beyond said spaced walls;

said spaced walls presenting a thickness different from said uniformed thickness of said peripheral wall of said bottom portion; and a pair of spaced members integral with and extending outwardly from said bottom portion at said front opening for receiving said plurality of cables extending thereto, a second plate removable connected to said spaced members for preventing relative movement of said cables relative said spaced members and preventing said cables from moving beyond said spaced members thereby keeping sail cables aligned between said spaced members and said spaced walls.

* * * * *